US007886382B2

(12) United States Patent
Funatogawa

(10) Patent No.: US 7,886,382 B2
(45) Date of Patent: Feb. 15, 2011

(54) PILLOW HAVING SLOPING PARTITION

(75) Inventor: Hiroyuki Funatogawa, Ashikaga (JP)

(73) Assignee: Kabushiki Kaisha Dokuta Eru (JP)

( * ) Notice: Subject to any disclaimer, the term of this patent is extended or adjusted under 35 U.S.C. 154(b) by 0 days.

(21) Appl. No.: 12/556,220

(22) Filed: Sep. 9, 2009

(65) Prior Publication Data

US 2010/0071134 A1 Mar. 25, 2010

(30) Foreign Application Priority Data

Sep. 22, 2008 (JP) ..... 2008-242341

(51) Int. Cl.
*A47C 20/00* (2006.01)

(52) U.S. Cl. ..... 5/636; 5/630; 5/645

(58) Field of Classification Search ..... 5/630, 5/632, 636, 637, 645
See application file for complete search history.

(56) References Cited

U.S. PATENT DOCUMENTS 4,773,107 A * 9/1988 Josefek ..... 5/636
D444,980 S * 7/2001 Mowat et al. ..... D6/601
7,032,264 B2 4/2006 Funatogawa ..... 5/636
7,562,405 B2 * 7/2009 Brogan ..... 5/645
7,698,763 B2 * 4/2010 Warnock ..... 5/655

FOREIGN PATENT DOCUMENTS

JP 2003-180499 7/2003

* cited by examiner

*Primary Examiner*—Fredrick Conley
(74) *Attorney, Agent, or Firm*—Bacon & Thomas PLLC

(57) ABSTRACT

The present invention provides a pillow inexpensively, in which a portion where the head of a user is rested is a hollow section which is evenly sloped and deformable bending of the neck or the tossing of the user. The pillow may have a sloped a sloping partition enclosing stuffing and located inside a pillow casing where the head of a user is rested, the sloped partition extending from the top cloth to the bottom cloth. The height of the sloping partition is slightly less than the clearance between the top and bottom cloths. A portion enclosed by the sloping partition on the top cloth side is a size in which the head of the user fits. The sloping partition is spaced from the neck side cloth inside the pillow casing.

20 Claims, 5 Drawing Sheets

PILLOW HAVING SLOPING PARTITION

BACKGROUND OF THE INVENTION

1. Field of the Invention

The present invention relates to an improvement in a pillow for use in which a sloping partition extending from the top cloth to the bottom cloth is provided inside a pillow casing, and stuffing materials are filled inside the pillow casing from a stuffing material insertion opening.

2. Description of the Related Art

Conventionally, there have existed pillows in which the inside of the pillow casing is separated into a plurality of sections, in order to prevent the stuffing materials such as feathers, pipe chips, Japanese cypress chips or cushion materials, all of which are filled into the pillow casing, from moving freely inside the pillow casing by the use of the pillow.

The pillows of this type include a pillow in which a plurality of sections are formed by sewing the top cloth and the bottom cloth directly by a sewing machine, etc., and a pillow in which a plurality of sections are formed by providing dividing walls at positions facing the top cloth and the bottom cloth as disclosed in Patent Reference 1. The pillows of such type had a disadvantage of deep hollows generated at the portions sewn by threads, and the dividing walls positioned approximately at right angles with respect to the top cloth and the bottom cloth, causing the occurrence of unevenness when the head is laid thereon in a case where a plurality of various stuffing materials are used, which leads to sensing of the seam.

In view of the situation, the present patent applicant has proposed a pillow as disclosed in Patent Reference 2 which does not generate unevenness caused by stuffing materials inside the separated sections, and which does not cause the user to sense the seam. The pillow has sloping partitions structured in such a way that the adjacent portions of the stuffing materials inside the intermediate partitioned section are positioned in the upper part of the adjacent portions of the stuffing materials inside the partitioned sections on both sides due to the load of the head applied to the pillow. While the pillow having sloping partitions is excellent in performance, it is difficult and troublesome to sew the sloping partitions, and in addition a plurality of stuffing material insertion openings must be provided, which makes the pillow expensive.

[Patent Reference 1] Japanese Unexamined Patent Publication No. 2003-180499

[Patent Reference 2] Japanese Unexamined Patent Publication No. 2005-287535

SUMMARY OF THE INVENTION

It is an object of the present invention to provide a pillow with an ideal shape inexpensively, in which a portion where the head of a user is rested is a hollow formed by a slope without unevenness, the shape of which is adequately deformable according to the bending of the neck or the tossing of the user, and which is produced with less troublesome sewing and fewer stuffing material insertion openings.

According to the first invention, there is provided a pillow for use which has a sloping partition provided near a center inside a pillow casing and near a position where the head of a user opposite to the neck side is rested, the sloping partition enclosing stuffing materials near the position in such a manner as to extend from the top cloth to the bottom cloth, and the stuffing materials being filled into the pillow casing from a stuffing material insertion opening. The following means are employed for the pillow.

First, the height of the sloping partition is set slightly lower than the clearance between the top cloth and the bottom cloth.

Secondly, a portion enclosed by the sloping partition on the top cloth side is set to be a size in which the head of the user fits.

Thirdly, the whole sloping partition is set to be a sloping surface open toward the bottom cloth side from the top cloth side.

Fourthly, on the neck side, the sloping partition is disposed apart from the neck side cloth inside the pillow casing.

The second invention is a pillow having a sloping partition obtained by adding to the first invention a feature of the sloping partition being formed of a single cloth having an approximately planar U shape parted at a tip in the direction opposite to the neck side of a user; the third invention is a pillow having a sloping partition obtained by adding to the first or the second invention a feature of the sloping partition being shaped open wide toward a parted tip portion.

The fourth invention is a pillow having a sloping partition obtained by adding to the second or the third invention a feature of the parted tip portion of the sloping partition being set apart from a cloth inside the pillow casing in the direction opposite to the neck side; the fifth invention is a pillow having a sloping partition obtained by adding to any of the second to the fourth invention a feature of the sloping partition being a plain woven cloth cut on a positive bias to have a bilaterally symmetrical approximately U shape.

The sixth invention is a pillow having a sloping partition obtained by adding to the first to the fifth inventions a feature of a center auxiliary partition slightly lower than the clearance between the top cloth and the bottom cloth, elongated in the horizontal direction, shorter on the top cloth side and longer on the bottom cloth side being attached to the sloping partition on the neck side of a user in a manner sloping in the direction opposite to the neck side of the user; the seventh invention is a pillow having a sloping partition obtained by adding to the sixth inventions a feature of right and left auxiliary partitions elongated in the horizontal direction being provided to the right and left of the sloping partition.

According to the invention, the provision of the sloping partition as mentioned above inside the pillow casing can allow a hollow to be formed in the center potion of the surface of the pillow casing by a smooth slope with less unevenness and seams equivalent to the head of a user, thus making it possible to provide an ideal surface shape for a pillow. Further, the invention requires less troublesome sewing as compared with this type of conventional pillow which is provided with a plurality of sloping partitions, thus making it possible to provide a pillow inexpensively.

With regard to the effect of the fourth invention, if the sloping partition is positioned as specified in the second invention, only by providing a single stuffing material insertion opening at a side portion of the pillow casing, stuffing materials filled through the stuffing material insertion opening can be arranged around, thus further reducing the manufacturing labor.

The formation of the sloping partition as specified in the fifth invention allows the stretching direction and stretching ratio of the sloping partition to be even, and thus provides a laterally even hollow. In addition, the movement of the stuffing materials becomes even on the right and left sides, making the lateral deformation even, so that the shape of the pillow can be adequately adapted to the movement of the head or the tossing of a user.

Furthermore, by providing the auxiliary partitions as specified in the sixth and the seventh invention, it becomes possible to allow the shape of the pillow near the neck of a user to have a fit feeling and secure the adequate height when the user sleeps on his or her side as well as to cope with the movement of the head or the hollow where the head is rested.

DESCRIPTION OF THE PREFERRED EMBODIMENT

Figure 1:
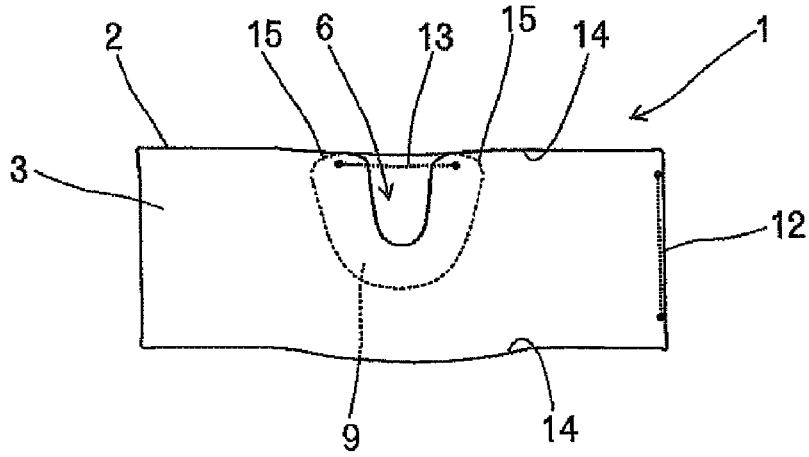
FIG. 1 is an explanatory plan view showing a first embodiment of a pillow having a sloping partition.
Figure 2:
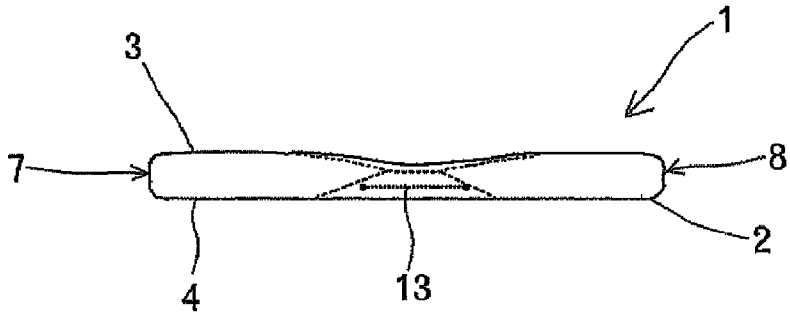
FIG. 2 is an explanatory front view of the embodiment as viewed from the neck side.

Hereinafter, descriptions are given regarding the embodiments as well as the mode for carrying out the present invention according to the drawings. FIGS. 1 to 4 are diagrams of a pillow 1 having a sloping partition according to the first embodiment; FIG. 1 is an explanatory plan view showing the appearance of the pillow 1 having the sloping partition according to the first embodiment; and the pillow 1 having the sloping partition consists of a pillow casing 2, a sloping partition 9 sewn to the inside the pillow casing 2, and stuffing materials 5 to be filled into the pillow casing 2. As the stuffing materials 5 per se may be those which have been conventionally used, they are not diagrammatically shown in FIGS. 1 to 3.

Figure 4:
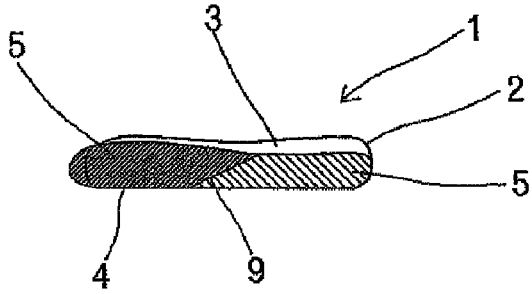
FIG. 4 is an explanatory side view of the embodiment.
Figure 7:
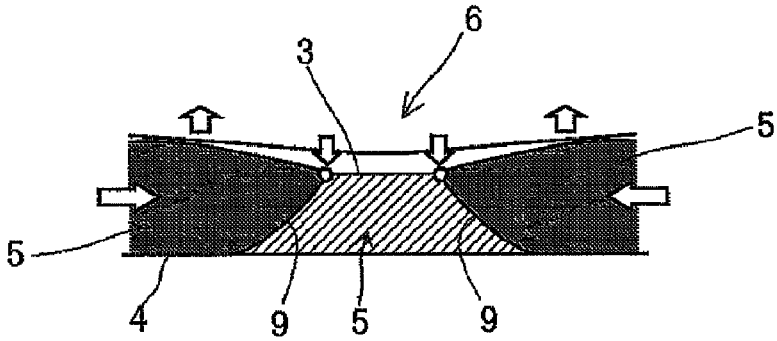
FIG. 7 is an explanatory cross-sectional view showing the role of the sloping partition.

As the stuffing materials 5, shown by shaded portions in FIGS. 4 and 7, chipped stuffing materials are used in general, but unit stuffing materials formed in a certain size can also be used. Particularly, they are effective when used partly, such as at a center portion 6 inside the pillow casing 2 (portion enclosed by the sloping partition 9). For chipped stuffing materials, feathers, resin chips, wood chips including Japanese cypress, cushion materials, buckwheat husks, tea leaves, and the like, which are materials suitable for being filled, are used.

On the other hand, unit stuffing materials consist of a bag with a certain volume into which chips such as feathers, resin chips, wood chips including Japanese cypress, cushion materials, buckwheat husks, tea leaves, and the like are stuffed. While the unit stuffing materials should preferably have a shape adapted to the shape of the area of the center portion 6 in a case where they are inserted into the center portion 6, those which approximately conform to the shape thereof would be sufficient.

Figure 3:
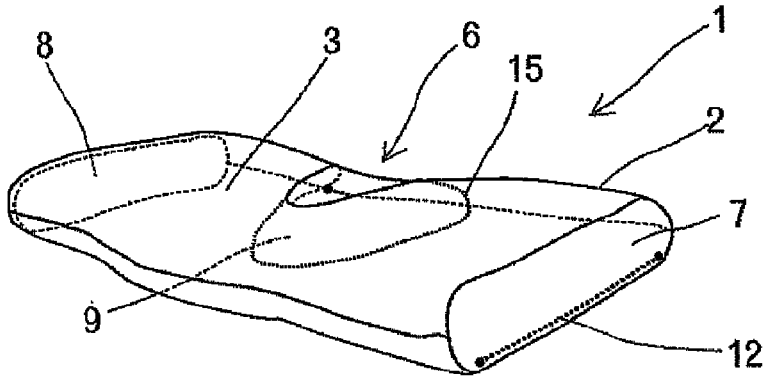
FIG. 3 is an explanatory perspective view showing the state of partition inside the pillow according to the embodiment.

In the first embodiment, the pillow casing 2 is a three-dimensionally sewn product made of a cloth, and, as shown in FIG. 3, is provided with the top cloth 3, bottom cloth 4, side clothes 7 and 8, the sloping partition 9 which is sewn to the inside the pillow casing 2, and stuffing material insertion openings 12, 13 provided on the side cloth 7 and back cloth of the pillow casing 2. The stuffing material insertion openings 12, 13 are openings through which the chipped stuffing materials or unit stuffing materials are put into or taken out of the interior of a partitioned section inside the pillow casing 2, and the unit stuffing materials or chipped stuffing materials are filled thereinto. The stuffing material insertion openings 12, 13 are designed to have a shape so as to facilitate filling of the stuffing materials or prevent them from leaking.

According to the first embodiment, as apparent from FIG. 3, the pillow casing 2 is produced by sewing a single cloth including the top cloth 3, the bottom cloth 4, the front and the back at the front, with the side clothes 7, 8 and the sloping partition 9 alone being produced with each individual clothe. However, without limiting thereto, all of the top cloth, the bottom cloth, the front and the back may be independently individual clothes, so that they are sewn to provide the pillow casing 2.

Figure 10:
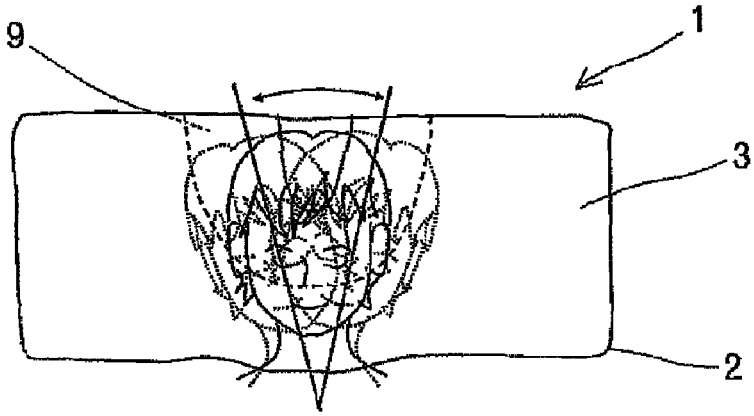
FIG. 10 is an explanatory plan view showing the movement of stuffing materials to cope with the bending of the neck.

The sloping partition 9 is provided at the center portion 6 in the pillow casing 2 according to the first embodiment as shown in FIGS. 1 to 4. The sloping partition 9 has an approximately planar U shape parted at the tip in the direction opposite to the body side (neck side) of a user of the pillow casing 2. The U shape is not strict, and, ideally, the preferable shape of the center portion 6 of the surface (top surface side) of the pillow 1 having the sloping partition gradually becomes wider toward the parted tip portion so as to follow the movement of the head of the user as shown in FIG. 10, and is designed to open at an angle shown in FIG. 10.

It is to be noted that the sloping partition 9 according to the invention is intended to enclose stuffing materials near the position where the head is rested, so that it should not necessarily have the tip portion parted as the approximately U shape, and may be a conical sloping partition, although it is not illustrated. In a case where such sloping partition is employed, however, a dedicated stuffing material insertion opening needs to be formed on the bottom cloth 4.

Figure 5:
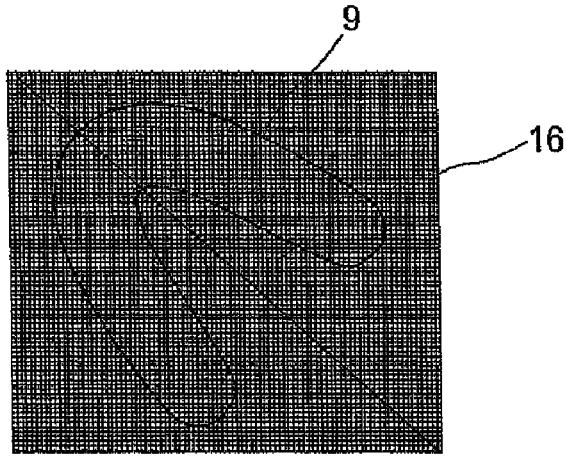
FIG. 5 is an explanatory diagram of the production of the sloping partition.
Figure 6:
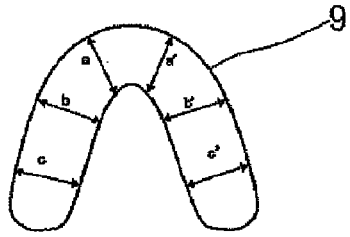
FIG. 6 is an explanatory diagram of the shape balance of the sloping partition.

The sloping partition 9 is produced with a plain woven cloth 16 which is cut on a positive bias as shown in FIG. 5 to have a bilaterally symmetrical approximately U shape. At this time, it is preferable to set the widths on both sides to be identical as a=a', b=b' and c=c' as shown in FIG. 6. This can make the lateral and longitudinal stretching ratios and stretching directions of the sloping partition 9 identical. If the stretching ratios and stretching directions are not even in the lateral and longitudinal directions, sewing becomes difficult, thus making it difficult to balance the shape of the hollow on the pillow surface.

The inner edge portions of the sloping partition 9 are formed to have such a size that when it is sewn to the pillow casing 2 and the stuffing materials 5 are filled therein, the head of a user fits in the center portion 6 of the pillow casing 2, while the outer edge portions are formed in such a size as to provide a desired slope. Meanwhile, the widths of the sloping partition 9 (a, a', b, b', c, c' in FIG. 6) determine the height of the sloping partition 9 when sewn to the inside the pillow casing 2, and thus the height of the sewn sloping partition 9 is determined to be slightly lower than the clearance between the top cloth 3 and the bottom cloth 4.

The sloping partition 9 is sewn in such a manner as to have an approximately U shape that does not contact the cloth inside the pillow casing 2 in the direction opposite to the opening side. The pillow casing 2 and the sloping partition 9 need to be apart from each other on the neck side of a user, i.e., on the front side of the pillow.

Further, the sloping partition 9 is, as a whole, sewn in such a manner as to have a sloping surface which opens toward the bottom cloth 4 from the top cloth 3. While the inclination of the sloping partition 9 is set to 45 degrees in the first embodiment, it is desirable to incline it within a range of 30 to 60 degrees depending on the stuffing materials and other conditions.

The sloping partition 9 has the upper end portion sewn to the inside the top cloth 3, and has the lower end portion sewn to the inside the bottom cloth 4. Further, an opening end portion 15 of the sloping partition 9 is sewn to the inside the back side cloth of the pillow casing 2. This allows the inside of the sloping partition 9 to be an independent separated space inside the pillow casing 2.

A description will now be given of a method of filling the stuffing materials 5 into the pillow 1 having the sloping partition according to the first embodiment, and of the later state of the pillow 1 having the sloping partition. The stuffing materials are filled into the center portion 6 of the pillow 1 having the sloping partition through the stuffing material insertion opening 13, and simultaneously the stuffing materials 5 are filled into the peripheral portions surrounding the center portion 6 through the stuffing material insertion opening 12.

When the stuffing materials 5 are filled in a necessary and sufficient amount, the stuffing materials 5 expand the peripheral portion on the top cloth 3 side of the pillow upward, and the center portion 6 on the top cloth 3 side of the pillow has a sloping surface so that the height of the sloping partition 9 is lower than the clearance between the top cloth 3 and the bottom cloth 4 and the shape of the sloping partition 9 opens toward the bottom cloth 4 from the top cloth 3 as indicated by arrows in FIG. 7. This makes it possible to produce an ideal pillow shape whose top cloth 3 side forms a smooth hollow and whose bottom cloth 4 side hardly deforms.

Figure 8:
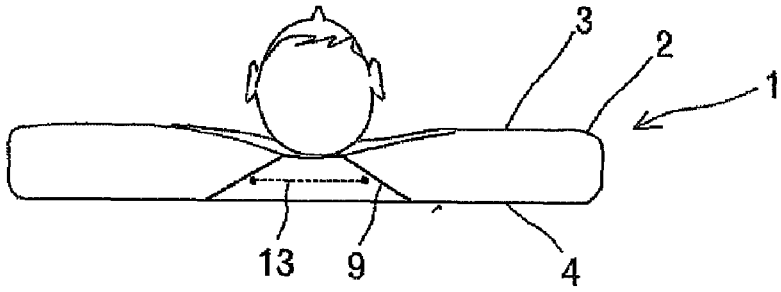
FIG. 8 is an explanatory view showing the pillow in use as viewed from the head.
Figure 9:
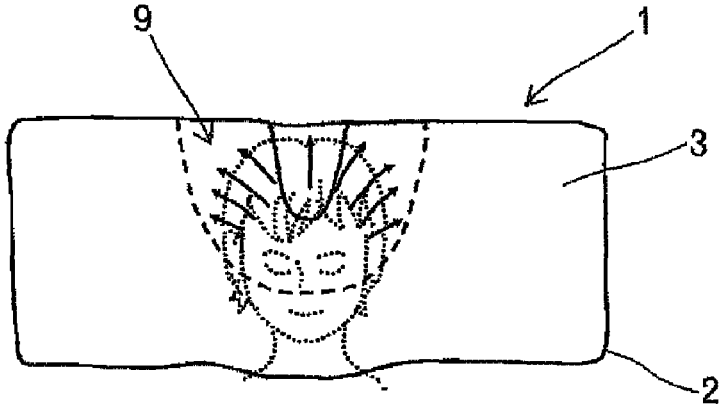
FIG. 9 is an explanatory plan view showing the movement of stuffing materials with the head laid on the pillow.

As shown in FIGS. 8 and 9, the user uses the pillow resting the head on the center portion 6 of the pillow 1 having the sloping partition. During that time, in the case of the conventional pillow, the weight of the user's head moves a large amount of the stuffing materials located at that position to the peripheral portions. However, the center portion 6 is the separated space closed by the sloping partition 9, and thus it is possible to prevent a large amount of the stuffing materials at the center portion 6 from moving to the peripheral portions. Further, the stuffing materials 5 which are moved by the weight of the user's head are in the arrowhead directions in FIG. 9, so that an adequate hollow shape can be secured.

Figure 11:
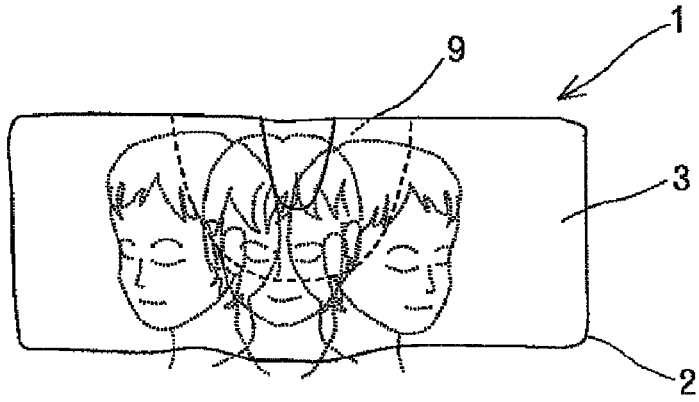
FIG. 11 is an explanatory plan view showing the movement of stuffing materials at the time of tossing.

Furthermore, the sloping partition 9 is shaped to gradually open toward the side of the parted tip portion, i.e., in the direction opposite to the neck side of the user as shown in FIG. 10, thereby enabling to ensure a shape change that follows the movement of the head as shown in FIG. 10 or 11.

Although the same stuffing materials 5 are used in the center portion 6 and the peripheral portion in the first embodiment, the use of different stuffing materials 5 can create various feelings different from the one obtained by a pillow having the same stuffing materials.

Figure 12:
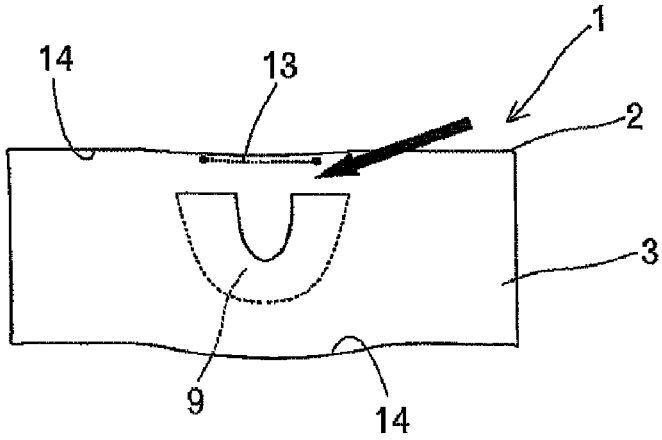
FIG. 12 is an explanatory plan view showing a second embodiment.

FIG. 12 is an explanatory plan view showing a second embodiment. While a pillow 1 having a sloping partition according to the second embodiment has substantially the same structure as that of the pillow according to the first embodiment, both pillows differ from each other in that the parted tip portion of the sloping partition 9 is set apart from the back-side interior of the pillow casing 2. The sloping partition 9 is sewn only to the top cloth 3 and the bottom cloth 4 in this manner, thereby enabling to fill the stuffing materials 5 into the entire pillow casing 2 only by forming a single stuffing material insertion opening 13, which makes it possible to achieve a pillow which can be produced easily and inexpensively.

Figure 13:
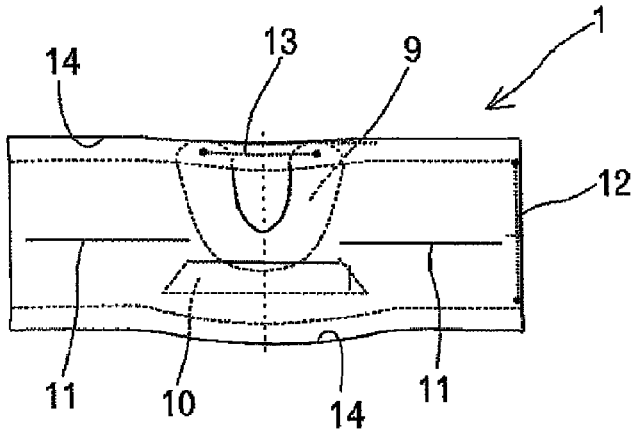
FIG. 13 is an explanatory plan view showing a third embodiment.
Figure 14:
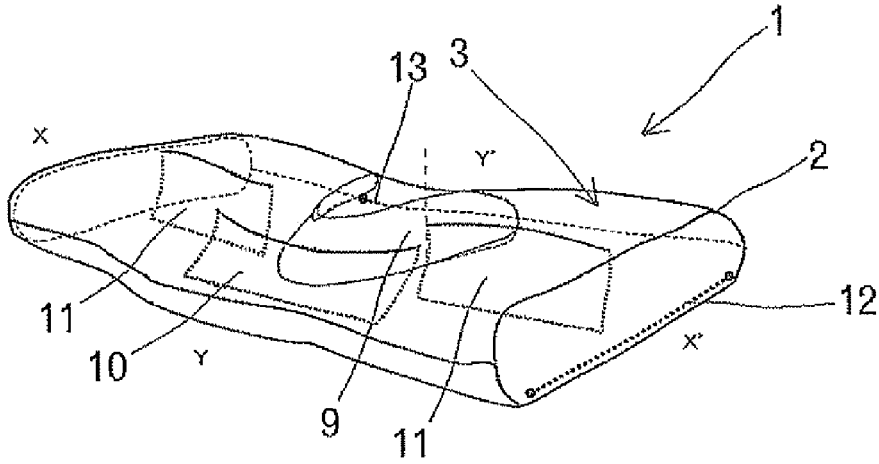
FIG. 14 is an explanatory perspective view showing the third embodiment.

FIG. 13 is an explanatory plan view showing a pillow 1 having a sloping partition according to a third embodiment which has auxiliary partitions 10, 11, and FIG. 14 is an explanatory perspective view of the same pillow. The pillow 1 having the sloping partition according to the third embodiment includes a pillow casing 2 and stuffing materials filled into the pillow casing 2, and has substantially the same structure as that of the first embodiment, except that the center auxiliary partition 10 is provided on the front side (neck side of the user) of the sloping partition 9 and the right and left auxiliary partitions 11 are provided to the right and left of the sloping partition 9.

Figure 15:
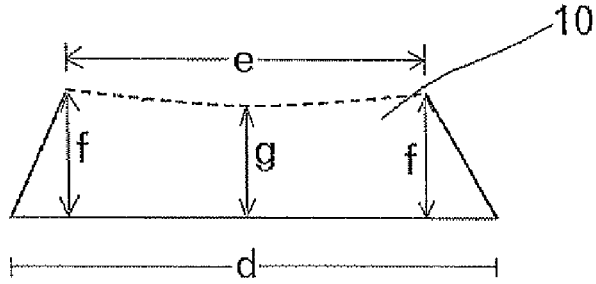
FIG. 15 is an explanatory diagram showing the shape of a center auxiliary partition.

The center auxiliary partition 10 is sewn to the top cloth 3 and the bottom cloth 4 on the front side (neck side of the user) of the sloping partition 9 in a lateral state slightly wider than the width of the sloping partition 9, with sloping rearward (in the direction opposite to the neck side of the user). As shown in FIG. 15, the center auxiliary partition 10 has a trapezoidal shape whose top side e to be sewn to the top cloth 3 is shorter than its bottom side d; center height g is slightly lower than heights f on both sides thereof; and the top side e has an arcuate shape dented in the center. Because this partition is the one for allowing the portion where the neck of the user abuts to be formed lower, its height and shape are determined to conform thereto.

The center auxiliary partition 10 is provided at an inclination of 45 degrees toward the rear side (on the opposite side to the neck side of the user). While the inclination is set to 45 degrees in the third embodiment, in the same manner as the inclination of the sloping partition 9, it may range from 30 degrees to 60 degrees according to the properties of the stuffing materials, or the like.

Although the right and left auxiliary partitions 11 are not sloping and stand upright in the third embodiment, they may be sloping rearward in the same manner as the center auxiliary partition 10. The right and left auxiliary partitions 11 restrict the forward and backward movements of the stuffing materials 5 (forward and backward directions from the neck side of the user toward the opposite direction), and can prevent uneven distribution of the stuffing materials when the pillow is used lying on its side.

What is claimed is:

1. A pillow having a sloping partition provided near a center inside a pillow casing and near a position where the head of a user opposite to a neck side is rested, the sloping partition enclosing stuffing materials near the position in such a manner as to extend from a top cloth to a bottom cloth, and the stuffing materials being filled into the pillow casing from a stuffing material insertion opening, wherein a height of the sloping partition is set slightly lower than a clearance between the top cloth and the bottom cloth; a portion enclosed by the sloping partition on the top cloth side is set to be a size in which the head of the user fits; the whole sloping partition is set to be a sloping surface open toward a bottom cloth side from a top cloth side; and on the neck side, the sloping partition is disposed apart from the neck side of the pillow casing.

2. The pillow according to claim 1, wherein the sloping partition is formed of a single cloth having an approximately planar U shape parted at a tip in the direction opposite to the neck side of a user.

3. The pillow according to claim 2, wherein the sloping partition is shaped open wide toward a parted tip portion.

4. The pillow according to claim 3, wherein the parted tip portion of the sloping partition is set apart from a cloth inside the pillow casing in the direction opposite to the neck side.

5. The pillow according to claim 4, wherein the sloping partition is a plain woven cloth cut on a positive bias to have a bilaterally symmetrical approximately U shape.

6. The pillow according to claim 5, wherein a center auxiliary partition slightly lower than the clearance between the top cloth and the bottom cloth, elongated in the horizontal direction, shorter on the top cloth side and longer on the bottom cloth side is attached to the sloping partition on the neck side of a user in a manner sloping in the direction opposite to the neck side of the user.

7. The pillow according to claim 6, wherein right and left auxiliary partitions elongated in the horizontal direction are provided to the right and left of the sloping partition.

8. The pillow according to claim 3, wherein the sloping partition is a plain woven cloth cut on a positive bias to have a bilaterally symmetrical approximately U shape.

9. The pillow according to claim 2, wherein the sloping partition is a plain woven cloth cut on a positive bias to have a bilaterally symmetrical approximately U shape.

10. The pillow according to claim 9, wherein a center auxiliary partition slightly lower than the clearance between the top cloth and the bottom cloth, elongated in the horizontal direction, shorter on the top cloth side and longer on the bottom cloth side is attached to the sloping partition on the neck side of a user in a manner sloping in the direction opposite to the neck side of the user.

11. The pillow according to claim 10, wherein right and left auxiliary partitions elongated in the horizontal direction are provided to the right and left of the sloping partition.

12. The pillow according to claim 2, wherein the parted tip portion of the sloping partition is set apart from a cloth inside the pillow casing in the direction opposite to the neck side.

13. The pillow according to claim 12, wherein the sloping partition is a plain woven cloth cut on a positive bias to have a bilaterally symmetrical approximately U shape.

14. The pillow according to claim 13, wherein a center auxiliary partition slightly lower than the clearance between the top cloth and the bottom cloth, elongated in the horizontal direction, shorter on the top cloth side and longer on the bottom cloth side is attached to the sloping partition on the neck side of a user in a manner sloping in the direction opposite to the neck side of the user.

15. The pillow according to claim 14, wherein right and left auxiliary partitions elongated in the horizontal direction are provided to the right and left of the sloping partition.

16. The pillow according to claim 1, wherein the sloping partition is shaped open wide toward a parted tip portion.

17. The pillow according to claim 16, wherein the parted tip portion of the sloping partition is set apart from a cloth inside the pillow casing in the direction opposite to the neck side.

18. The pillow according to claim 17, wherein the sloping partition is a plain woven cloth cut on a positive bias to have a bilaterally symmetrical approximately U shape.

19. The pillow according to claim 18, wherein a center auxiliary partition slightly lower than the clearance between the top cloth and the bottom cloth, elongated in the horizontal direction, shorter on the top cloth side and longer on the bottom cloth side is attached to the sloping partition on the neck side of a user in a manner sloping in the direction opposite to the neck side of the user.

20. The pillow according to claim 19, wherein right and left auxiliary partitions elongated in the horizontal direction are provided to the right and left of the sloping partition.

* * * * *